US005768903A

United States Patent [19]

Sekigami et al.

[11] Patent Number: 5,768,903

[45] Date of Patent: Jun. 23, 1998

[54] REFRIGERATING APPARATUS, AIR CONDITIONER USING THE SAME AND METHOD FOR DRIVING THE AIR CONDITIONER

[75] Inventors: Kunie Sekigami, Oota; Kouji Nagae; Kazutoyo Kagami, both of Ooizumimachi, all of Japan

[73] Assignee: Sanyo Electric Co., Ltd., Oosaka, Japan

[21] Appl. No.: 612,173

[22] Filed: Mar. 7, 1996

[30] Foreign Application Priority Data

Mar. 9, 1995 [JP] Japan ..... 7-078324
May 31, 1995 [JP] Japan ..... 7-157016

[51] Int. Cl.[6] ..... F25B 1/10

[52] U.S. Cl. ..... 62/196.2; 62/196.3; 62/228.5

[58] Field of Search ..... 62/196.1, 196.2, 62/196.3, 228.4, 228.5, 204, 222

[56] References Cited

U.S. PATENT DOCUMENTS 2,165,741 7/1939 Wolfert ..... 62/196.3
2,245,053 6/1941 Sanders, Jr. ..... 62/196.2 X
2,319,130 5/1943 Hanson ..... 62/196.2 X
2,401,827 6/1946 Heitchue ..... 62/196.2 X
2,555,005 5/1951 Warneke ..... 62/196.2 X
2,774,219 12/1956 Kelley ..... 62/196.3 X
2,961,148 11/1960 Courtney, Jr. ..... 62/196.2 X
5,577,390 11/1996 Kaido et al. ..... 62/228.5

*Primary Examiner*—Harry B. Tanner
*Attorney, Agent, or Firm*—Darby & Darby

[57] ABSTRACT

In a refrigerating machine having a heat exchanger, a rated compressor for which the frequency of driving power is fixed, a power control mechanism which is disposed in the compressor and serves to return a part of the refrigerant in the cylinder under a compressing process to the cylinder under sucking process, a refrigerant return mechanism for returning a part of the refrigerant discharged from the compressor to a refrigerant suction side of the compressor, and a controller for selectively controlling the power control mechanism and the refrigerant return mechanism to make the output power variable. A pole-changeable type compressor having a pole changer may be used in place of the rated compressor having the power control mechanism, and the output power is made variable by selectively controlling the pole changer and the refrigerant return mechanism.

7 Claims, 11 Drawing Sheets

FIG. 12

| DRIVING CONTROL OF 4-HORSEPOWER COMPRESSOR | | |
|---|---|---|
| POWER-CHANGING MECHANISM \ POWER CONTROL MECHANISM | 50% SAVED (RETURN VALVE OPENED) | FULL POWER (RETURN VALVE OPENED) |
| 2-POLE DRIVING (RETURN VALVE OPENED) | 2 HORSEPOWERS (1 HORSEPOWER) | 4 HORSEPOWERS (3 HORSEPOWERS) |
| 4-POLE DRIVING (RETURN VALVE OPENED) | 1 HORSEPOWER | 2 HORSEPOWERS (1 HORSEPOWER) |

REFRIGERATING APPARATUS, AIR CONDITIONER USING THE SAME AND METHOD FOR DRIVING THE AIR CONDITIONER

BACKGROUND OF THE INVENTION

1. Field of the Invention

The present invention relates to a refrigerating apparatus for circulating refrigerant in a refrigerant circuit such as an air conditioner, a refrigerating machine or the like, an air conditioner using the refrigerating apparatus, and a method for driving the air conditioner.

2. Description of Related Art

There has been known a refrigerating machine and an air conditioner as shown in FIG. 1. In the air conditioner (refrigerating machine) as shown in FIG. 1, compressors 81 and 91, an oil separator 82, a four-way valve 83, a condenser 84, a pressure-reducing device 85, a receiver tank 86, a pressure-reducing device 92, and an evaporator 87 are connected to one another in turn to construct a refrigerant circuit. Reference numeral 84*a* represent fans for the condenser. In this type of refrigerating machine (air conditioner), when an air conditioning load is varied, the power of the compressor is varied in accordance with the variation of the air conditioning load. An inverter compressor has been generally known as a means of varying the power of the compressor, and it varies the power of the compressor by varying the frequency of driving power. However, when an inverter compressor is used as a compressor, the conventional technique as described above has an advantage that a continuous driving operation of finely controlling the amount of the refrigerant (refrigerating power) discharged from the compressor in a broad range can be performed, however, it has the following problems. That is, the price of an apparatus rises up (the manufacturing cost of the apparatus rises up). In addition, higher harmonic waves of power occur through the operation of the inverter, and these high-frequency components of the power have adverse effects on the apparatus, for example, they bring noises to peripheral equipments (computer, etc.) surrounding the high-frequency component source or break out capacitors (electrical parts).

On the other hand, there has been known another technique in which the air conditioning power is varied in accordance with an air conditioning load by using a rated compressor for which the frequency of driving power is fixed, in place of the inverter compressor. In the following description, the "rated compressor" means a compressor having a motor which is designed to be driven at a fixed driving power frequency (i.e., the frequency of driving power for the motor is invariable). Therefore, the output power of the motor of the rated compressor itself is invariable. In order to vary the air conditioning power, this technique further needs a refrigerant return mechanism for returning a part of the refrigerate discharged from the rated compressor to the suction side of said rotated compressor. That is, this technique can perform a multistage control operation of the power by using the rated compressor with the assistance of the refrigerant return mechanism. In this case, although the above problems are avoidable, the driving control cannot be smoothly performed to induce hunting, and further the control range is limited to an extremely small range. The hunting causes the variation at the room temperature to be intensified, so that a comfortable air conditioning operation cannot be performed. In addition, the air conditioner has been hitherto required to achieve simplification in structure and reduction in number of parts, etc., however, this requirement has not yet been satisfied.

SUMMARY OF THE INVENTION

An object of the present invention is to provide a refrigerating machine which can prevent occurrence of hunting and has no adverse effect on peripheral equipments, and also which can be designed in a simple structure and can reduce the number of parts constituting the refrigerating machine.

Another object of the present invention is to provide an air conditioner using the refrigerating machine as described above.

Another object of the present invention is to provide a method of driving the air conditioner as described above.

In order to attain the above objects, according to a first aspect of the present invention, a refrigerating machine includes a heat exchanger for performing heat exchanger between a refrigerant and air, a rated compressor (having rated frequency) for which the frequency of driving power is fixed, and which has at least one cylinder for compression, a power control mechanism which is disposed in the compressor and serves to return a part of the refrigerant in the cylinder under a compressing process to the cylinder under sucking process, a refrigerant return mechanism for returning a part of the refrigerant discharged from the compressor to a refrigerant suction side of said compressor, and a controller for selectively controlling the power control mechanism and the refrigerant return mechanism to make compression power variable.

The refrigerating machine as described above may include plural rated compressors, and at least one of the compressors includes the power control mechanism as described above.

According to a second aspect of the present invention, an air conditioner which is equipped with plural indoor units each having an indoor heat exchanger, and an outdoor unit having an outdoor heat exchanger and a compressor, includes a refrigerating machine which comprises a heat exchanger for performing heat exchanger between a refrigerant and air, a rated compressor for which the frequency of driving power is fixed, and which has at least one cylinder, a power control mechanism which is disposed in the compressor and serves to return a part of the refrigerant in the cylinder under a compression process to the cylinder under sucking process, a refrigerant return mechanism for returning a part of the refrigerant discharged from the compressor to a refrigerant suction side of said compressor, and a controller for selectively controlling the power control mechanism and the refrigerant return mechanism to vary a compression power of the compressor.

The air conditioner as described above may further include a control valve which is provided to each indoor unit and is actuated in both cooling and heating operations to control the amount of the refrigerant flowing in each indoor heat exchanger and thus control an output power of said air conditioner in accordance with an air conditioning load, thereby performing the cooling and heating operations which meet the air conditioning load.

According to a third aspect of the present invention, a refrigerating machine includes a heat exchanger for performing heat exchanger between a refrigerant and air, a pole-changeable type compressor having at least one cylinder and a pole-changing mechanism, at least one of a refrigerant return mechanism for returning a part of the refrigerant discharged from the pole-changeable type compressor to a refrigerant suction side of said compressor and a power control mechanism for returning a part of the refrigerant in the cylinder under a compression process to the cylinder under sucking process, and a controller for selectively controlling the pole-changing mechanism of the pole-changeable type compressor and at least one of the refrigerant return mechanism and the power control mechanism to make compression power variable.

The refrigerating machine as described above may include plural compressors, and at least one of the compressors is equipped with the power control mechanism as described above.

According to a fourth aspect of the present invention, an air conditioner which is equipped with plural indoor units each having an indoor heat exchanger, and an outdoor unit having an outdoor heat exchanger and a compressor, includes a refrigerating machine which includes a heat exchanger for performing heat exchanger between a refrigerant and air, a pole-changeable type compressor having at least one cylinder for compression and a pole-changing mechanism, at least one of a refrigerant return mechanism for returning a part of the refrigerant discharged from the pole-changeable type compressor to a refrigerant suction side of said compressor and a power control mechanism for returning a part of the refrigerant in the cylinder under a compression process to the cylinder under sucking process, and a controller for selectively controlling the pole-changing mechanism of the pole-changeable type compressor and at least one of the refrigerant return mechanism and the power control mechanism to make compression power variable.

The air conditioner as described above may further include a control valve which is provided to each indoor unit and is actuated in both cooling and heating operations to control the amount of the refrigerant flowing in each indoor heat exchanger and thus control an output power of said air conditioner in accordance with an air conditioning load of the indoor unit to perform the cooling and heating operations which meet the air conditioning load.

According to a fifth aspect of the present invention, a method of driving an air conditioner including plural indoor units each having an indoor heat exchanger and a control valve for controlling a flow-in amount of refrigerant into the indoor heat exchanger, and an outdoor unit having an outdoor heat exchanger, a rated compressor having at least one cylinder for compression, a refrigerant return mechanism for returning a part of the refrigerant discharged from the compressor to a refrigerant suction side of said compressor and a power control mechanism for returning a part of the refrigerant in the cylinder under a compression process to the cylinder under sucking process, comprises the steps of controlling an opening degree of the control valve in accordance with the air conditioning load to perform a cooling or heating operation meeting the air conditioning load in a small range, and controlling selectively the driving of the refrigerant return mechanism and the power control mechanism when it is impossible to perform the cooling or heating operation in accordance with the air conditioning load by only the control of the control valve, whereby the output power of the compressor can be controlled variably.

According to a sixth aspect of the present invention, a method of driving an air conditioner including plural indoor units each having an indoor heat exchanger and a control valve for controlling a flow-in amount of refrigerant into the indoor heat exchanger, and an outdoor unit having an outdoor heat exchanger, a pole-changeable type compressor having at least one cylinder and a pole-changing mechanism, and at least one of a refrigerant return mechanism for returning a part of the refrigerant discharged from the compressor to a refrigerant suction side of said compressor and a power control mechanism for returning a part of the refrigerant in the cylinder under a compression process to the cylinder under sucking process, comprises the steps of controlling an opening degree of the control valve in accordance with the air conditioning load to perform a cooling or heating operation meeting the air conditioning load in a small range, and controlling selectively the driving of the pole-changeable type compressor and at least one of the refrigerant return mechanism and the power control mechanism when it is impossible to perform the cooling or heating operation in accordance with the air conditioning load by only the control of the control valve.

According to the present invention of the first aspect of the present invention, a part of the refrigerant in the cylinder of the compressor under the compression process is returned to the cylinder under the sucking process by the power control mechanism, and/or a part of the refrigerant discharged from the compressor is returned to the suction side of said compressor by the refrigerant return mechanism, whereby the refrigeration power can be variably controlled with only the rated compressor. As described above, the refrigeration power can be controlled by using the power control mechanism and the refrigerant return mechanism in combination, whereby the compression power can be finely controlled in a broad range with only the rated compressors, so that hunting can be prevented.

According to the present invention, the output power (compression power) can be controlled substantially linearly like an inverter compressor. In addition, since an inverter compressor in which the frequency of power to be supplied to a motor of the compressor is variable is unnecessary, peripheral equipments suffer no adverse effect.

According to the refrigerating machine as described above, unlike the conventional inverter compressor, no inverter (frequency converter) is necessary, and the amount of circulating refrigerant is adjusted by the control valve of the indoor unit, so that it is unnecessary to provide a valve for controlling the refrigerant amount in the outdoor unit. Therefore, the outdoor unit is not required to have a receiver and a control valve which have been used in the prior art, so that the refrigerating machine can be designed in a simple structure and the number of parts can be reduced.

The same effect as described above can be obtained by using a pole-changeable type compressor having a pole-changing mechanism in place of the combination of the rated compressor and the power control mechanism. In this case, the refrigeration power can be finely controlled by using a refrigerant return mechanism for returning a part of the refrigerant discharged from the compressor to the suction side of said compressor. In addition, no inverter (frequency converter) is necessary, and the amount of circulating refrigerant is adjusted by the control valve of the indoor unit, so that it is unnecessary to provide a valve for controlling the refrigerant amount in the outdoor unit. Therefore, in this case, the outdoor unit is also not required to have a receiver and a control valve which have been used in the prior art, so that the refrigerating machine can be designed in a simple structure and the number of parts can be reduced.

According to the present invention, the refrigerating machine as described above includes plural compressors, and at least one of the compressor comprises a rated compressor having a power control mechanism, or a pole-changeable type compressor having a pole-changing mechanism. Therefore, in addition the above effect, the control can be more finely controlled in a broader range by selectively combining the respective compressors.

According to the present invention, a multiroom type air conditioner includes the refrigerating machine as described above. Therefore, the refrigeration power can be finely controlled in a broad range in each indoor unit, and thus a comfortable air condition can be obtained. Further, the amount of the refrigerant to be supplied to the indoor unit can be controlled through the control of the power of the compressor and the control valve of each indoor unit, so that other equipments for controlling the refrigerant amount, for example, a receiver, etc., are not required for the outdoor unit. Therefore, the air conditioner can be designed in a simple construction and the number of parts can be reduced.

In the multiroom type air conditioner, the refrigerant amount to be supplied to each indoor unit is controlled by the control valve provided to the indoor unit, and thus the air conditioning operation can be performed in accordance with the air conditioning load without the receiver and the open/close valve of the outdoor heat exchanger which are required in the conventional air conditioner. Accordingly, the structure of the air conditioner can be simplified, and the number of parts can be reduced.

According to the present invention, the refrigerant amount to be supplied to the indoor unit can be controlled more finely (for example, substantially linearly) in accordance with the air conditioning load (for example, in proportion to the air conditioning load) by controlling the refrigerant control mechanism (the pole-changing mechanism, the refrigerant return mechanism, the power control mechanism) and the opening degree, of the control valve. In addition, even when the refrigerant amount to be fed under pressure in accordance with variation of the load varies, no receiver and no open/close valve of the outside unit are required. Therefore, the construction can be simplified, and the number of parts can be reduced.

Further, the amount of the refrigerant flowing into the indoor heat exchanger is beforehand adjusted in a small range by the control valve of the indoor unit before the refrigerant control mechanism (the pole-changing mechanism, the refrigerant return mechanism, the power control mechanism) is actuated, so that the refrigerating machine or the air conditioner can perform the optimum driving operation which meets the real-time air conditioning load, and thus more stable and comfortable air condition can be obtained.

BRIEF DESCRIPTION OF THE DRAWINGS

FIG. 12 is a table for the driving control when the pole-changing mechanism and the power control mechanism are used in combination in the air conditioner of FIG. 11.

DETAILED DESCRIPTION OF PREFERRED EMBODIMENTS

Preferred embodiments according to the present invention will be described hereunder with reference to the accompanying drawings.

In the following description, a multiroom separate type air conditioner is representatively used. However, the air conditioner to which the present invention is applicable is not limited to the above air conditioner, and it may be any type of air conditioner or refrigerating machine.

Figure 2:
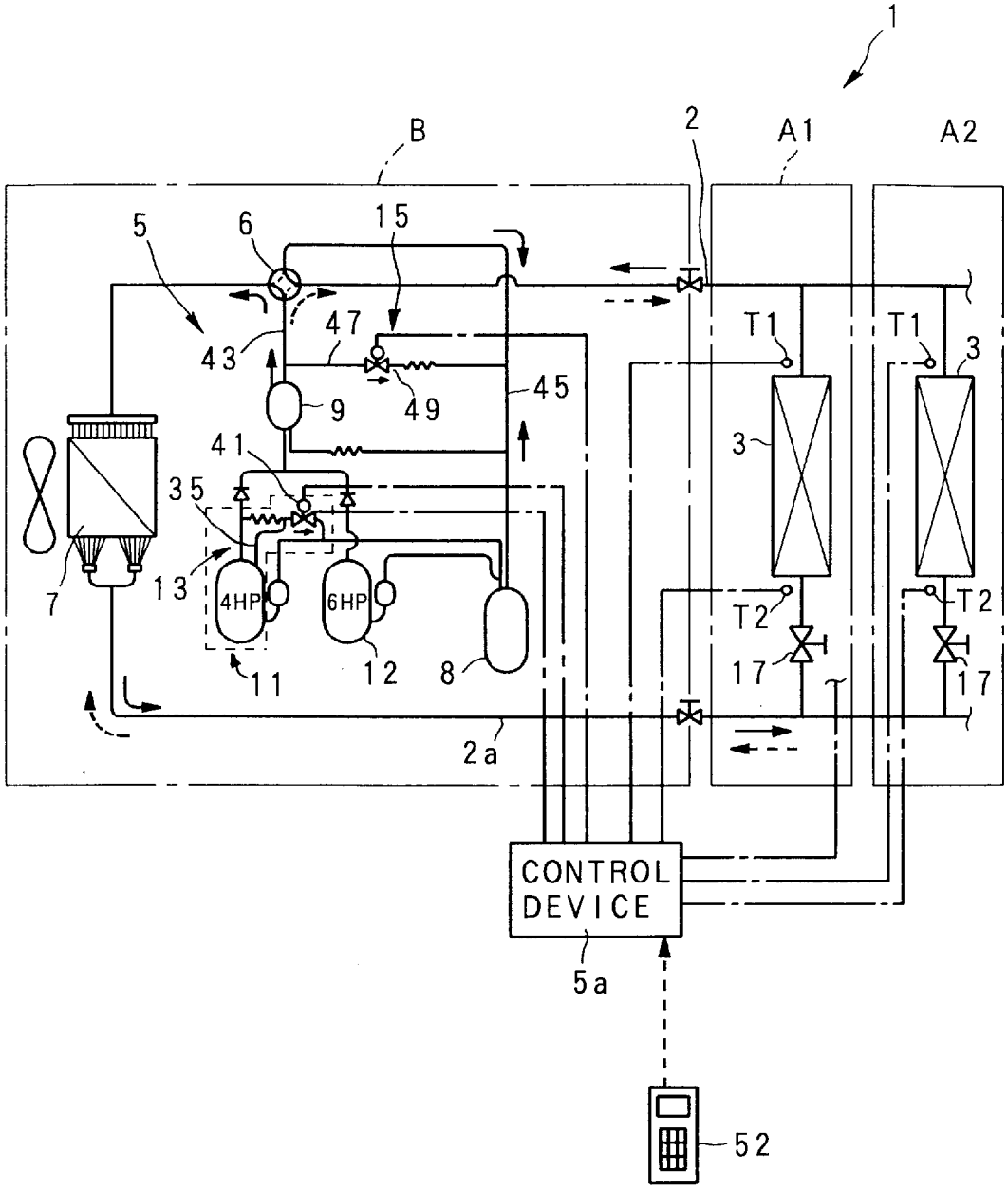
FIG. 2 is a refrigerant circuit diagram showing an air conditioner of an embodiment of the present invention.

In FIG. 2, a multiroom separate type air conditioner 1 according to a first embodiment of the present invention comprises plural indoor units A1 and A2, an outdoor unit B and an inter-unit pipe 2 for connecting both the units A1 and A2 to the outdoor unit B. Each of the indoor units A1 and A2 include has an indoor heat exchanger which operates as an evaporator in a cooling operation and also as a condenser in a heating operation, and an indoor fan (not shown).

Each of the indoor units A1 and A2 is provided with temperature sensors T1 and T2 at the inlet and outlet sides of the indoor heat exchanger 3, and temperature signals are transmitted from the sensors T1 and T2 to a controller 5*a* to measure an air conditioning load of each indoor heat exchanger 3. Each indoor unit A1, A2 is further provided with the indoor heat exchanger 3, and a control valve 17 serving as a pressure reducer. The control valve 17 is closed to stop the refrigerant to flow into the indoor heat exchanger 3 interlockingly with stop of the driving of each indoor unit A1, A2. The control valve 17 also serves to adjust its opening degree so that the flow-in amount of the refrigerant into the indoor heat exchanger 3 is controlled in accordance with an air conditioning load.

That is, according to the present invention, the flow-in amount of the refrigerant into the indoor heat exchanger 3 is controlled by the control valve 17, whereby the output power of the air conditioner can be temporarily controlled in accordance with the air conditioning load irrespective of a load status of the outdoor unit B. The power control operation of the air conditioner by the control valve is limited to a small range, and thus when a large power variation is required, it does not satisfy this requirement. In this case, a refrigerant control mechanism (a pole-changing mechanism, a refrigerant return mechanism, a power control mechanism) as described later must be used to control the output power of the compressor in a broad range.

The outdoor unit B is provided with a refrigerant control apparatus 5 comprising the compressor (as described later), etc., and it controls the power of the compressor, etc. in response to control signals which are transmitted from the control device 5*a* through control lines indicated by one-dotted chain lines. The outdoor unit B further includes a four-way valve 6, an outdoor heat exchanger operating as a condenser in a cooling operation and as an evaporator in a heating operation, an accumulator 8 and an outdoor fan.

In this embodiment, small-diameter pipes are used for the indoor heat exchanger 3 and the outdoor heat exchanger 7. For example, the diameter of an normal pipe is about 9 mm, and the diameter of the pipes of this embodiment is about 7 mm which is smaller than that of the normal pipe. Therefore, the price of the pipes is lower and the pipe size thereof is smaller. Accordingly, by using the pipes having small diameter, the size of the refrigerant circuits at the side of the indoor units A1 and A2 can be reduced, and the amount of the refrigerant supplied to the refrigerant circuit can be reduced.

Figure 1:
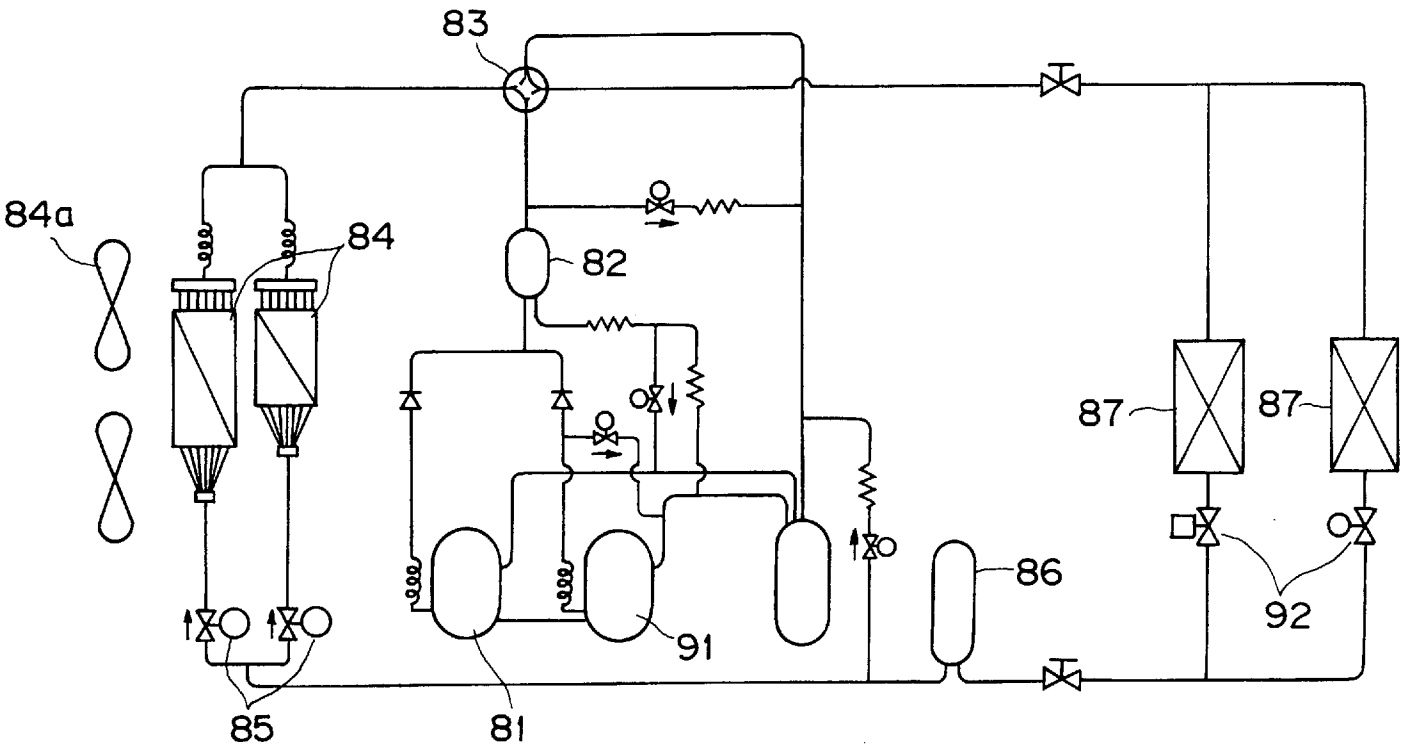
FIG. 1 PRIOR ART
FIG. 1 is a refrigerant circuit diagram showing a conventional air conditioner.

Further, in the whole refrigerant circuit of the air conditioner 1, pressure reducers used in the refrigerant circuit are only the control valves 17 of the indoor units A1 and A2, and the pressure reducer 5 and the receiver tank 86 which has been required for the conventional air conditioner as shown in FIG. 1 are not necessary to be disposed in the refrigerant circuit of this embodiment.

As shown in FIG. 2, the refrigerant control apparatus 5 is provided two compressors 11 and 12, and each of the compressors 11 and 12 is connected to an accumulator 8 at the suction side thereof and to an oil separator 9 at the discharge side thereof. In this embodiment, the one compressor 11 has four horsepowers and the other compressor 12 has six horsepowers. Each of the two compressors 11 and 12 comprises a so-called rated compressor. As described above, the "rated compressor" means a compressor having a motor which is designed to be driven at a fixed driving power frequency. Therefore, the power of the rated compressor itself is invariable. However, if a power control mechanism as described later is built in the rated compressor, the power of the rated compressor is variable with the assistance of the power control mechanism.

In this embodiment, a power control mechanism 13 is built in only the compressor 11 (which has smaller horsepower) as shown in FIG. 2. The power control mechanism saves the output (horsepower) of the compressor 11 to vary the refrigerant amount discharged from the compressor 11. That is, it serves to return a part of the refrigerant in a cylinder of the compressor 11 under a compressing process to another cylinder of the compressor 11 under sucking process. Therefore, the output power of the compressor 11 is made variable although the frequency of the driving power for the compressor 11 is fixed (i.e., the compressor 11 itself has invariable power).

In this embodiment, the refrigerant control apparatus 5 is further provided with a refrigerant return mechanism for returning a part of the refrigerants discharged from discharge pipes of both the compressors 11 and 12 to suction pipes 45 at the refrigerant suction sides of the compressors 11 and 12. The total output power of the compressors 11 and 12 is made variable through the refrigerant returning operation of the refrigerant return mechanism. Accordingly, the total output power of the compressors 11 and 12 can be controlled by the power control mechanism and/or the refrigerant return mechanism.

Next, the power control mechanism 13 and the refrigerant return mechanism 15 will be described in more detail.

First, the construction and operation of the power control mechanism 13 will be described with reference to FIGS. 3 and 4.

The power control mechanism 13 is designed as follows. As shown in FIGS. 3 and 4, the power control mechanism 13 has a rotational compressing element which is mounted in a sealed housing 18. The rotational compressing element comprises an intermediate partition plate 27, and a pair of cylinders 21 and 22 which are provided at both sides of the intermediate partition plate 27. First holes 23 and 24 are formed in the inner walls of the cylinders 21 and 22 respectively, and second holes 25 and 26 are formed in the cylinders 21 and 22 respectively so as to intercommunicate with the respective first holes 23 and 24. Further, a third hole 28 is formed in the intermediate partition wall 27 so as to intercommunicate with the second holes 25 and 26. Pistons 29 and 30 are mounted in the second holes 25 and 26 of the cylinders 21 and 22 respectively, and a coil spring 32 (a leaf spring or bellows may be used insofar as it is formed of elastic material) is disposed so as to bridge the pistons 29 and 30. A recess 31 is formed on the side wall of each cylinder, and the second holes 25 and 26 intercommunicate with fourth holes 33 and 34 through the recesses 31 of the cylinders 21 and 22 respectively. The fourth holes 33 and 34 are allowed to selectively intercommunicate with one of low-pressure and high-pressure sides of the external refrigerant circuit through a passage 35 by a change-over valve or the like.

Figure 3:
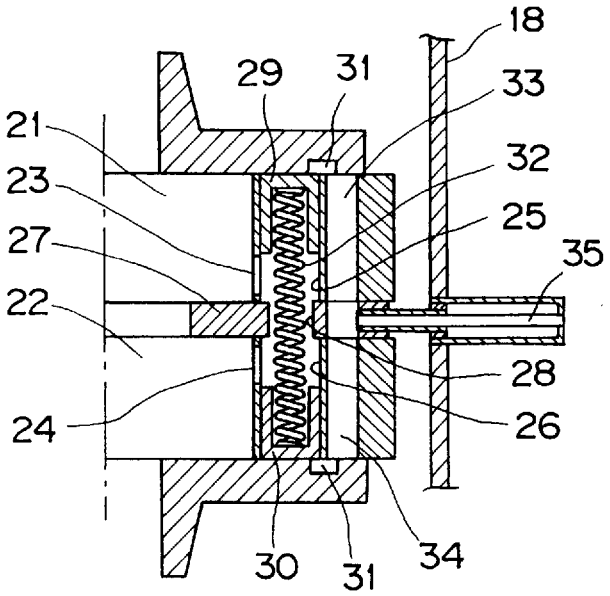
FIG. 3 is a cross-sectional view showing a power control mechanism which is built in a compressor shown in FIG. 2.
Figure 4:
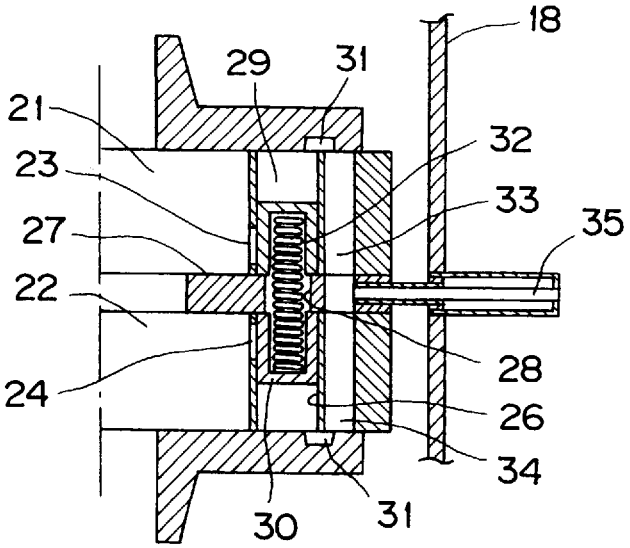
FIG. 4 is a cross-sectional view showing an operation of the power control mechanism shown in FIG. 3.

When the power control mechanism 13 is actuated by the control device 5*a*, as shown in FIG. 3, the pressure at the low-pressure side is applied as back pressure to the second holes 25 and 26 through the passage 35, the fourth holes 33 and 34 and the recess 31 to move the pistons 29 and 30 to the top dead points. At this time, the first holes 23 and 24 are allowed to intercommunicate with each other, and the gaseous refrigerant which is being compressed in the cylinder 21 is allowed to flow through the first hole 23, the second hole 25, the third hole 28, the second hole 26 and the first hole 24 into the cylinder 22 under the sucking process, whereby a part of the refrigerant in the cylinder 21 under the compressing process is returned to the cylinder 22 under the sucking process to save a part of the output power of the compressor 11. On the other hand, when the power control mechanism 13 is not actuated (i.e., in a normal driving mode (non-save control mode)), as shown in FIG. 4, the pressure at the high-pressure is applied as back pressure to the second holes 25 and 26 through the passage 35, the fourth holes 33 and 34 and recesses 31 to move the pistons 29 and 30 to the bottom dead points. Therefore, both the first holes 23 and 24 are closed (i.e., are not allowed to intercommunicate with each other), and no refrigerant flows between the cylinders 21 and 22.

According to the power control mechanism 13, about a half of the output power of the compressor 11 can be saved. Accordingly, 2 horsepowers are saved from the output power (four horsepowers) of the compressor 11, that is, the output power of the compressor 11 can be reduced by 2 horsepowers when the power control mechanism 13 is actuated. The ON/OFF operation of the power control mechanism 13 is controlled on the basis of an instruction signal from the control device 5*a* by an open/close operation of a valve 41 (see FIG. 2). That is, at the ON time of the power control mechanism 13, the valve 41 is opened in response to the instruction signal, so that the low pressure is applied as back pressure from the accumulator 8 through the passage 35 to the power control mechanism 13. Therefore, a part of gas (refrigerant) in the cylinder 21 under the compression process leaks to the other cylinder 22 under the sucking process to perform power save. On the other hand, at the OFF time of the power control mechanism 13, the valve 41 is closed in response to the instruction signal, and the high pressure is applied as back pressure from the discharge side of the compressor 11 through the passage 35 to the power control mechanism 13. Therefore, the refrigerant is discharged to the oil separator 9 while no gas (refrigerant) leaks from the cylinder 21 under the compression process to the other cylinder 22 under the sucking process.

Next, the construction and operation of the refrigerant return mechanism 15 will be described with reference to FIG. 2.

The refrigerant return mechanism 15 serves to return a part of the total refrigerant discharged from both the discharge pipes of the rated compressors 11 and 12 to the suction pipes of the compressors 11 and 12. In this embodiment, the refrigerant return mechanism 15 includes a return pipe 47 for allowing a discharge pipe 43 disposed between the oil separator 9 and the four-way valve 6 to intercommunicate with the suction pipe 45 between the accumulator 8 and the four-way valve 6, and a return valve 49 provided to the return pipe 47. By opening/closing the return valve 49, a part of the discharged refrigerant is returned to the accumulator 8. According to the refrigerant return mechanism 15 of this embodiment, 1 horsepower is saved (reduced) from the total output horsepower of the compressors 11 and 12.

The return valve 49 is opened or closed on the basis of a control signal from the control device 5*a* to control the refrigerant amount (compressed output) supplied to the indoor units A1 and A2.

Next, the operation (variable control operation of output power using rated compressors) of the air conditioner of this embodiment will be described with reference to the refrigerant circuit of FIG. 2.

In the refrigerant circuit of the air conditioner shown in FIG. 2, the flow direction of the refrigerant is changed by switching the four-way valve 6 to selectively perform each of the cooling and heating operations of the air conditioner. In FIG. 2, the flow of the refrigerant in the cooling operation is indicated by solid lines, and the flow of the refrigerant in the heating operation is indicated by broken lines.

During the cooling or heating operation, the temperature sensors T1 and T2 of each indoor unit detect the temperature at the refrigerant inlet and outlet sides of the indoor heat exchanger 3, and transmit detection signals to the control device 5*a*. The control device 5*a* calculates an air conditioning load required for each indoor heat exchanger 3 on the basis of the temperature signals of the temperature sensors T1 and T2 and a set temperature signal from a remote controller 52, for example, and in accordance with the calculated load the control device 5*a* adjusts the opening degree of the control valve 17 of each indoor unit A1, A2 or controls the output power of the refrigerant control apparatus 5 to thereby perform the refrigerant control operation.

Next, the a refrigerant control method will be described.

Figure 6:
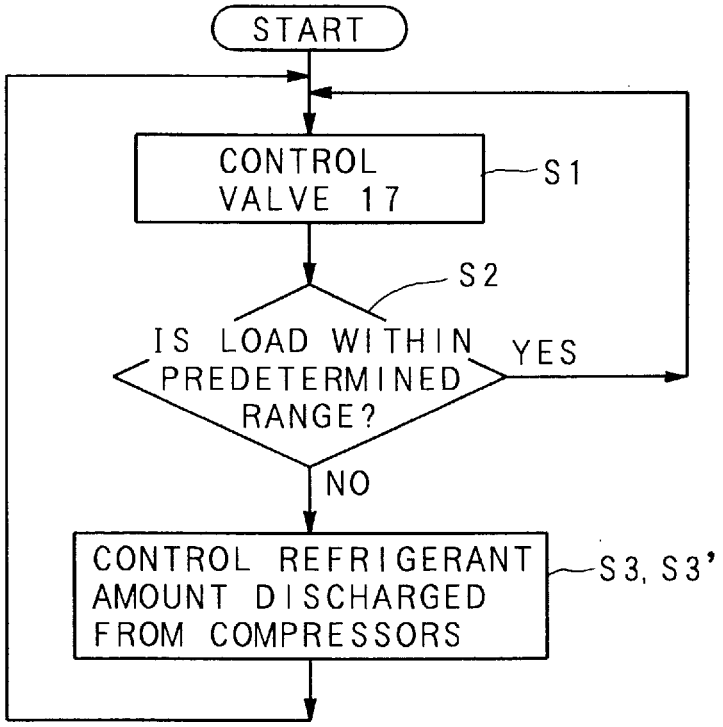
FIG. 6 is a schematic flowchart for power control of the air conditioner of this embodiment.

As shown in FIG. 6, at first the control device 5*a* controls the opening degree of the control valve 17 on the basis of the detected load in step S1. Subsequently, in step S2, it is judged whether the load is within a predetermined range (level). Specifically, it is judged whether the difference |T0–T3| between a room temperature T0 and a set temperature T3 (which is set through a remote controller 52 by an user) is smaller than a predetermined value F. If the difference |T0–T3| is judged to be below the predetermined value F, the process returns to the step S1. On the other hand, if the difference |T0–T3| is judged to be larger than the predetermined value F, the process goes to step S3 to perform the power control with the refrigerant control apparatus 5.

That is, in this embodiment, the opening degree of the control valve 17 is first controlled. If the air conditioning (refrigeration) power cannot be controlled by only the control of the control valve 17, the power control of the compressors by the refrigerant control apparatus 5 is performed.

The control method based on the control valve 17 will be described in detail with reference to FIG. 7.

In step S11, an initial load |T0–T3| which is required for the indoor heat exchanger 3 is detected on the basis of the room temperature T0 and the set temperature T3, and then the process goes to step S12. In step S12, the valve opening degree of the control valve 17 is set to a suitable value in accordance with the initial load detected in the step S11, and the process goes to step S13. In step S13, $\Delta T=|T1-T2|$ is calculated on the basis of the inlet temperature T1 and the outlet temperature T2 of the heat exchanger 3, and then the process goes to step S14. In step S14, it is judged whether $\Delta T$ is equal to a predetermined value K. If $\Delta T$ is judged to be equal to the predetermined value K, the process returns to the step S13. On the other hand, If $\Delta T$ is judged not to be equal to the predetermined value K, the process goes to step S15.

In step S15, it is judged whether $\Delta T$ is larger than the predetermined value K. If $\Delta T$ is judged to be larger than the predetermined value K, the process goes to step S16 to open the control valve 17, and then goes to step S17 to perform the power control of the compressors on the basis of the refrigerant control apparatus 5. After the power control of the compressors is performed, the process returns to the step S13. On the other hand, if $\Delta T$ is judged not to be larger than the predetermined value K, the process goes to step S18 to close the control valve 17 by a predetermined degree so that the opening degree of the control valve is reduced, and then the process returns to the step S13.

In the case where the air conditioning (refrigerating) power cannot be performed by only the control of the valve opening degree of the control valve 17 as described above, the following power control of the compressors is performed by the refrigerant control apparatus 5.

The power control of the compressors which is performed in step S17 will be described with reference to FIG. 5.

Figure 5:
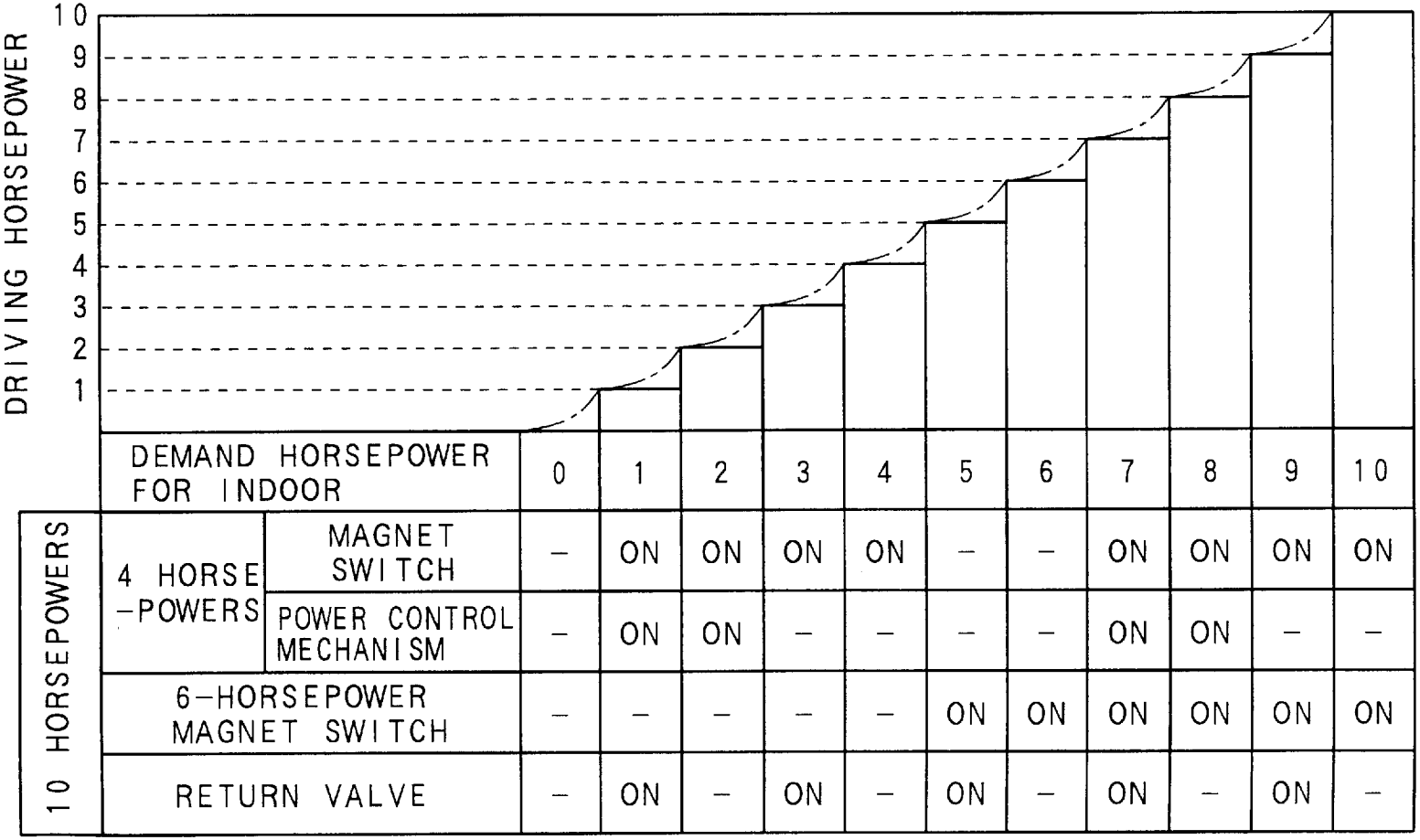
FIG. 5 is a diagram showing the relationship between variation of a driving horsepower (output power of the compressor) and a selective driving operation of the compressor.

FIG. 5 is a table showing the relationship between an output horsepower and a selective driving status of the power control mechanism 13 and the refrigerant return mechanism 15 when the output power of the compressed refrigerant is stepwise varied every horsepower in the refrigerant circuit of this embodiment. As is apparent from FIG. 5, the output power can be stepwise varied as indicated by a solid line by selectively driving the power control mechanism 13 and the refrigerant return mechanism 15 as described above, thereby obtaining a desired output power which meets an air conditioning load.

When the valve 41 of the power control mechanism 13 and the return valve 49 of the refrigerant return mechanism 15 are switched off (that is, the two valves are closed), the total output power of the two rated compressors 11 and 12 is equal to 10 horsepowers because they have four horsepowers and six horsepowers respectively.

When the desired output power (horsepower) is 10 horsepowers, only magnet switches which are provided to the two rated compressors 11 and 12 respectively are switched on. In this case, the driving status of the rated compressor 11 is shown in FIG. 4.

When the desired output power is 9 horsepowers, both the magnet switches of the rated compressors 11 and 12 are switched on, and the return valve 49 is opened (ON). In this case, a part of the discharged refrigerant which corresponds to 1 horsepower is returned through the return pipe 47 to the accumulator 8, and an output power of 9 horsepowers (=10 horsepowers (total output power of compressors 11 and 12) −1 horsepower) is finally output.

When the desired output power is 8 horsepowers, both the magnet switches of the rated compressors 11 and 12 are switched on, and the valve 41 of the power control mechanism 13 is opened (ON) while the return valve 49 is closed (−). In this case, the output power (4 horsepowers) of the compressor 11 is reduced to 2 horsepowers by the action of the power control mechanism 13, and the output power (6 horsepowers) of the other compressor 12 remains unvaried. Therefore, the total output power of the compressors 11 and 12 is equal to 8 horsepowers (=2+6).

When the desired output power is 7 horsepowers, both the magnet switches of the rated compressors 11 and 12 are switched on, and the return valve 49 and the valve 41 of the power control mechanism 13 are opened (ON). In this case, the output power of the compressor 11 is reduced to 2 horsepowers by the power control mechanism 13, and thus the total output power of the two compressors 11 and 12 is equal to 8 horsepowers just after the refrigerant is discharged therefrom. Further, the total output power (8 horsepowers) is reduced to 7 horsepowers by the refrigerant return mechanism 15 because the refrigerant discharged from the compressors is partially returned to the accumulator by 1 horsepower.

The other desired output powers from 6 horsepowers to 0 horsepower can be also obtained in the same manner as described above. That is, in this embodiment, the output power can be finely (stepwise) controlled every one horsepower in the range from 0 horsepower to 10 horsepower by selectively opening or closing (ON or −) the valve 41 of the power control mechanism 13 and the return valve 4 of the refrigerant return mechanism 15 as shown in FIG. 5.

According to this embodiment, the output power is more finely controlled by the fine control operation of the control valve 17 in a small or fine range. That is, by selectively controlling the control valve 17, the power control mechanism 13 and the refrigerant return mechanism 15, the output power can be smoothly controlled substantially linearly as indicated by a one-dotted chain line as shown in FIG. 5, like a smooth and linear power control obtained by an inverter compressor. Therefore, a desired smooth and variable (substantially linearly variable) output power can be obtained by using only the rated compressors with no inverter compressor. Accordingly, the adverse effects such as noises, etc. due to the inverter compressor can be avoided, and the cost of the apparatus can be reduced.

Further, this embodiment has the features (1) the pipe diameter of the indoor heat exchanger is set to 7 mm, which is smaller than the pipe diameter of the outdoor heat exchanger (9 mm), and (2) the control valve 17 serving as the pressure reducer of the refrigerant is disposed at only the indoor units A1 and A2, so that the refrigerant flowing in the inter-unit pipe is kept in a liquid state in both the cooling and heating operations. Accordingly, (3) the refrigerant amount sealed in the refrigerant circuit can be minimized with the features (1) and (2). Therefore, the receiver tank and the open/close valve are unnecessary, and the number of parts can be reduced.

Figure 8:
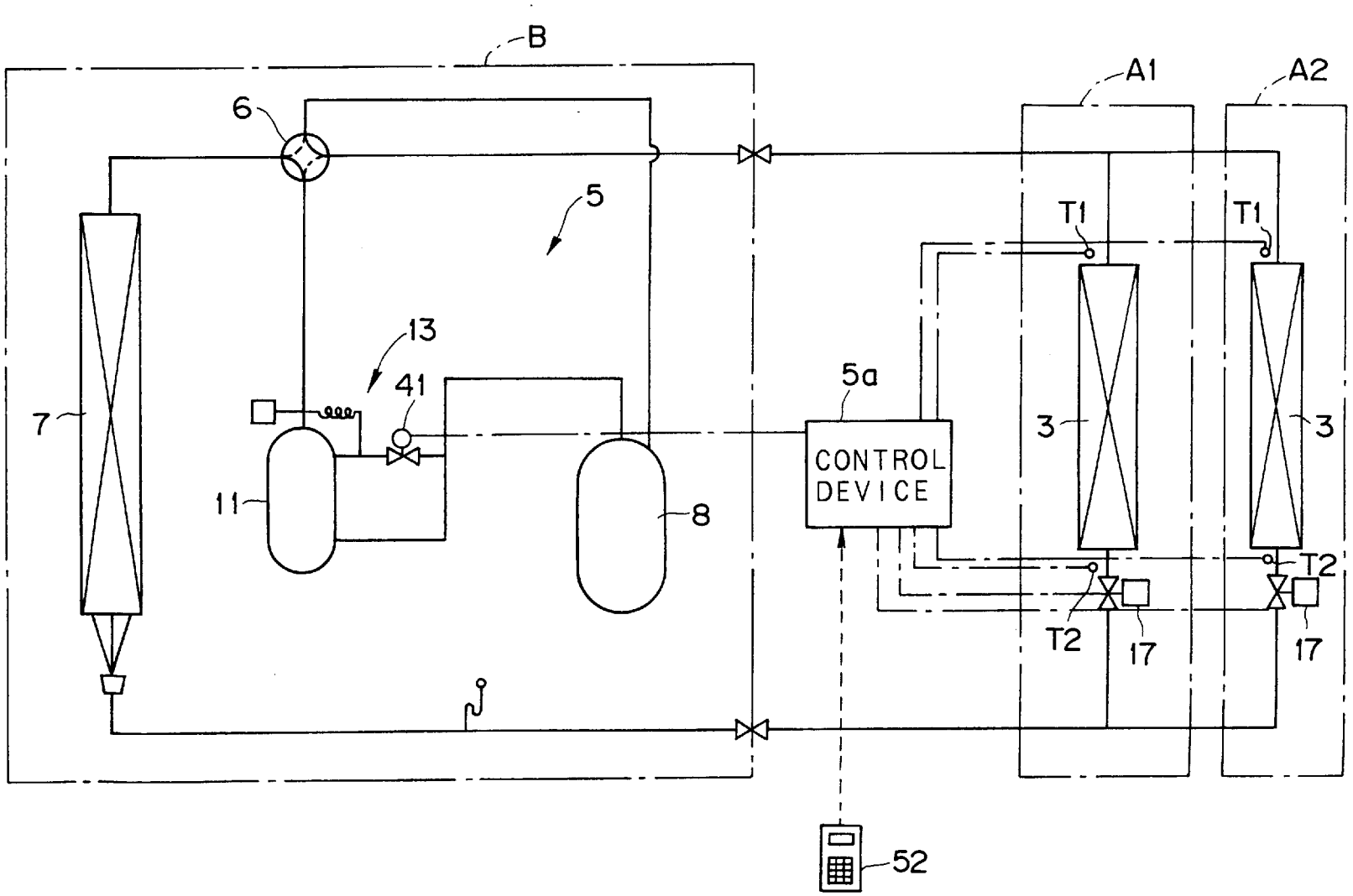
FIG. 8 is a refrigerant circuit diagram showing an air conditioner which is a modification of the embodiment of FIG. 2.

The refrigerant control device 5 as described above may be designed to have a compressor which has only one cylinder and a power control mechanism 13 as shown in FIG. 8. In this case, the output power is controlled every two horsepowers.

Further, the present invention is not limited to a multiroom-type air conditioner having plural indoor units A, and the same effect can be obtained even when one indoor unit A is used.

Figure 9:
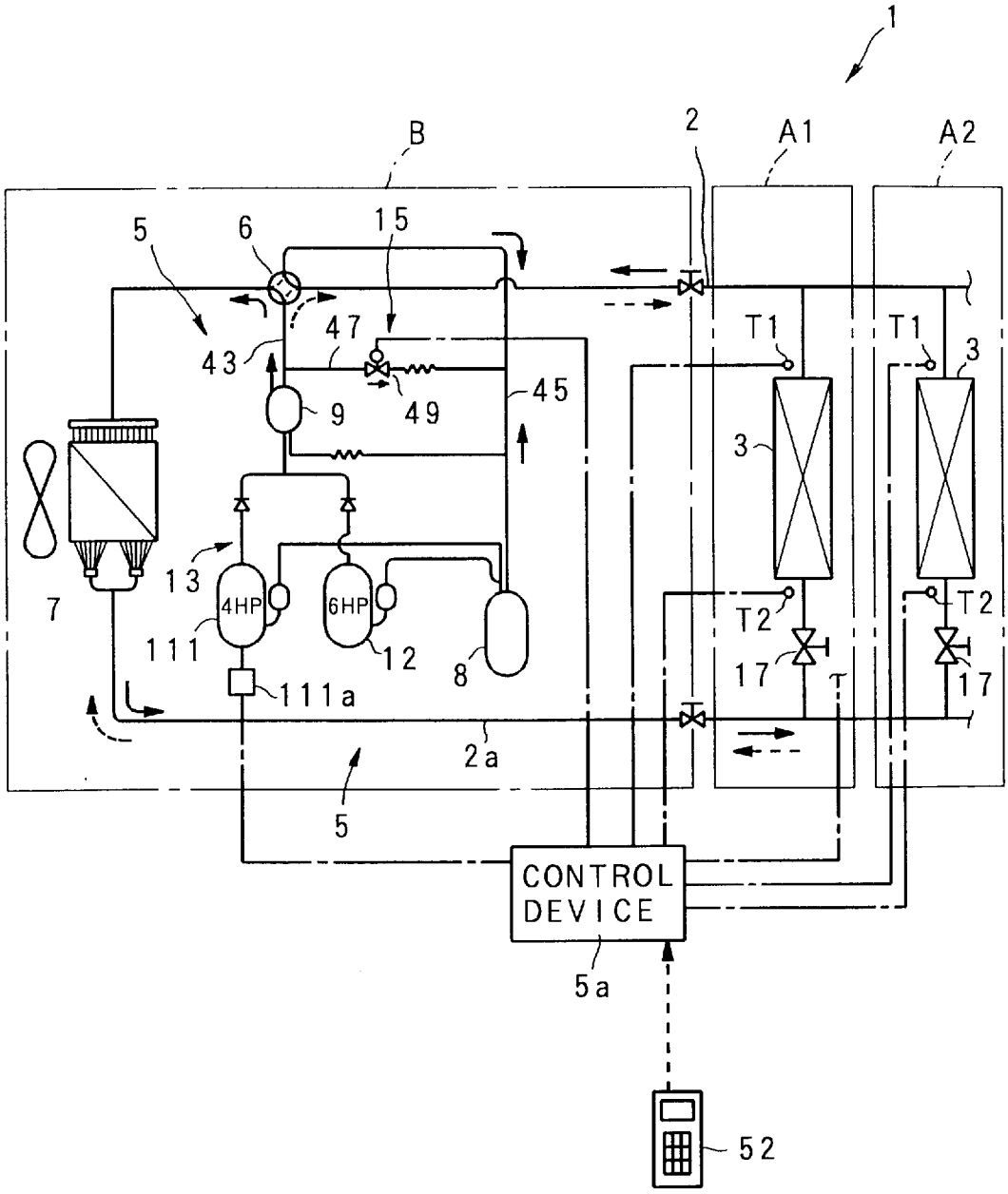
FIG. 9 is a refrigerant circuit diagram of an air conditioner according to a second embodiment of the present invention, and which corresponds to the refrigerant circuit diagram of the air conditioner of FIG. 2.
Figure 10:
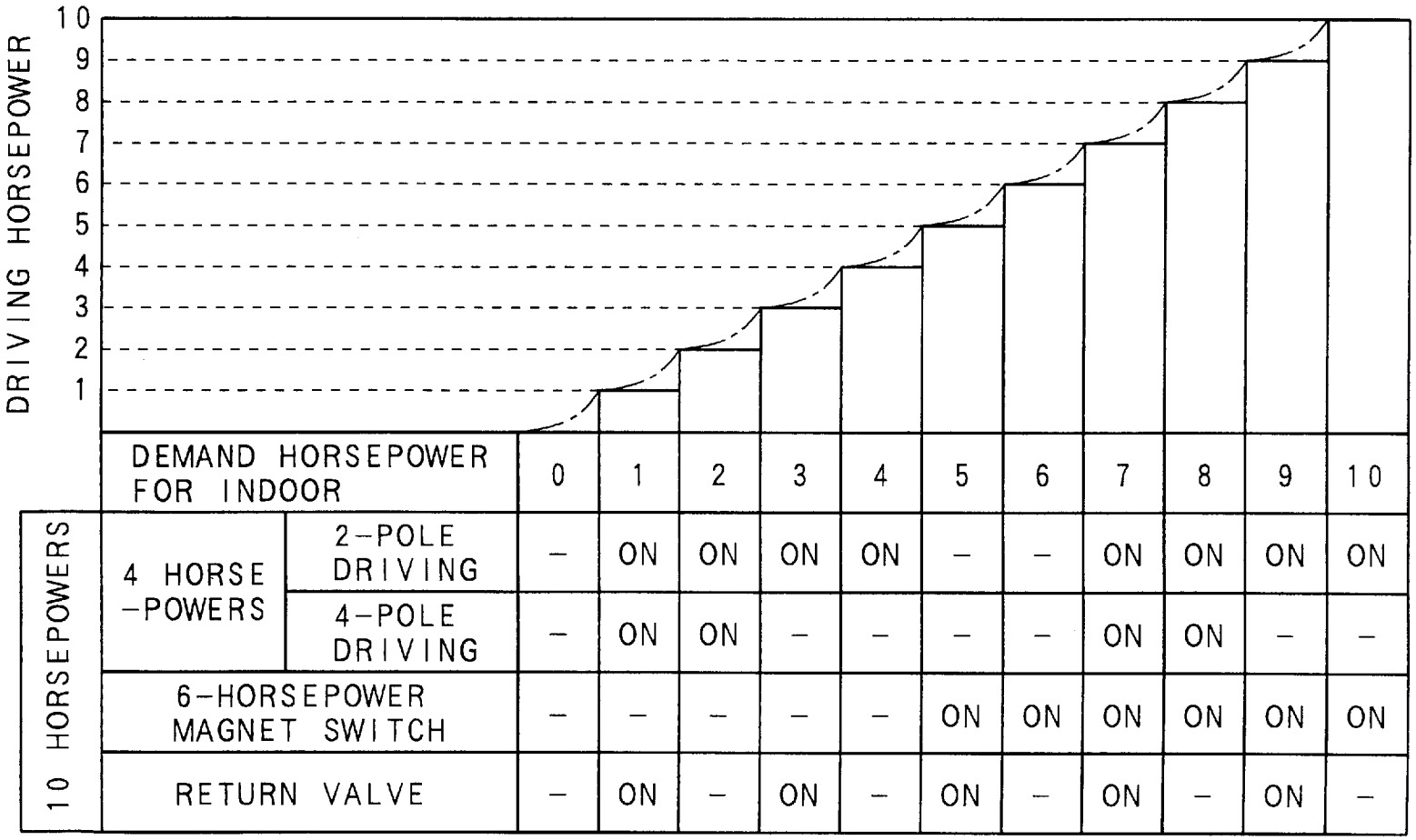
FIG. 10 is a diagram showing the relationship between variation of a driving horse power (output power of the compressor) and the selective driving operation of the compressor in the second embodiment.

FIG. 9 is a refrigerant circuit for an air conditioner according to a second embodiment of the present invention.

The difference between this embodiment and the embodiment shown in FIG. 2 resides in that a pole-changeable type compressor 111 is used in place of the rated compressor having the power control mechanism 13. The "pole-changeable type compressor" means a compressor having a motor whose number of poles is changeable, and thus the rotational number of the motor is variable, so that the output power of the compressor is finally variable. By changing the number of the poles of the motor, the rotational number of the motor is varied and thus the output power of the compressor is also varied.

In this embodiment, when the pole-changeable type compressor 111 changes the number of poles of a motor thereof from two poles to four poles in response to an instruction from a pole changer 111*a* for changing the number of poles of the motor, the rotational number of the motor is reduced to a half (i.e., the output power is reduced to a half). On the other hand, when the pole-changeable type compressor 111 changes the number of the poles from four poles to two poles, the rotational number of the compressor is multiplied twice. That is, in the first embodiment the output power of the compressor is reduced (to a half) by actuating the power control mechanism, and in this embodiment the output power of the compressor is reduced (to a half) by using the pole-changeable type compressor.

Figure 7:
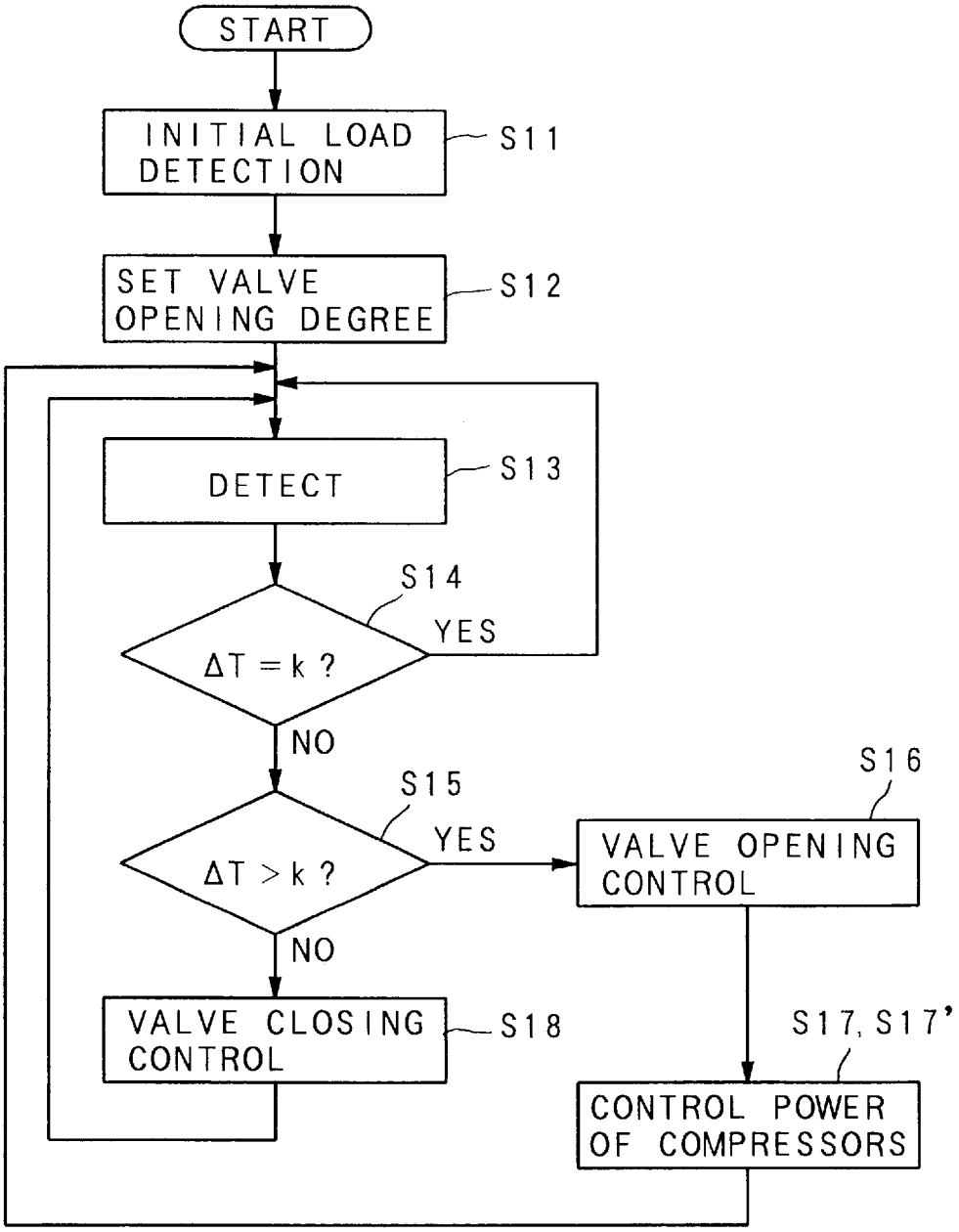
FIG. 7 is a flowchart showing a detailed control process shown in FIG. 6.

The power control operation of this embodiment is substantially identical to that of the first embodiment except that the switching operation of the power control mechanism is replaced by the pole-changing operation of the compressor, and thus the same control flow as shown in FIGS. 6 and 7 are applicable to this embodiment. That is, the opening degree of the control valve 17 is first controlled in accordance with an air conditioning load in the same manner as the first embodiment. Specifically, when the air conditioning load increases, the opening degree of the control valve 17 of each indoor unit A1, A2 is increased (the valve is opened). On the other hand, when the air conditioning load decreases, the opening degree of the control valve 17 of each indoor unit A1, A2 is reduced (the valve is closed). If the power control based on the control of the control valve 17 cannot follow the variation of the air conditioning load, the number of poles of the compressor motor is changed in response to an instruction from the pole changer 111*a* to increase or decrease the discharge amount of the refrigerant from the compressor in step 3' of FIG. 6 and step 17' of FIG. 7, or the return valve 49 is opened to return a part of the refrigerant discharged from the compressors 111 and 12 through the return pipe 47 to the accumulator 8 as shown in FIG. 9. These control operation is performed by the control device 5*a* like the first embodiment.

According to this embodiment, the output power is stepwise controlled from 0 horsepower to 10 horsepowers as indicated by a solid line by controlling the pole-changeable type compressor and the refrigerant return mechanism 15. By further controlling the control valve 17, the output power can be smoothly and substantially linearly controlled as indicated by a one-dotted chain line, like the power control of an inverter compressor.

Figure 11:
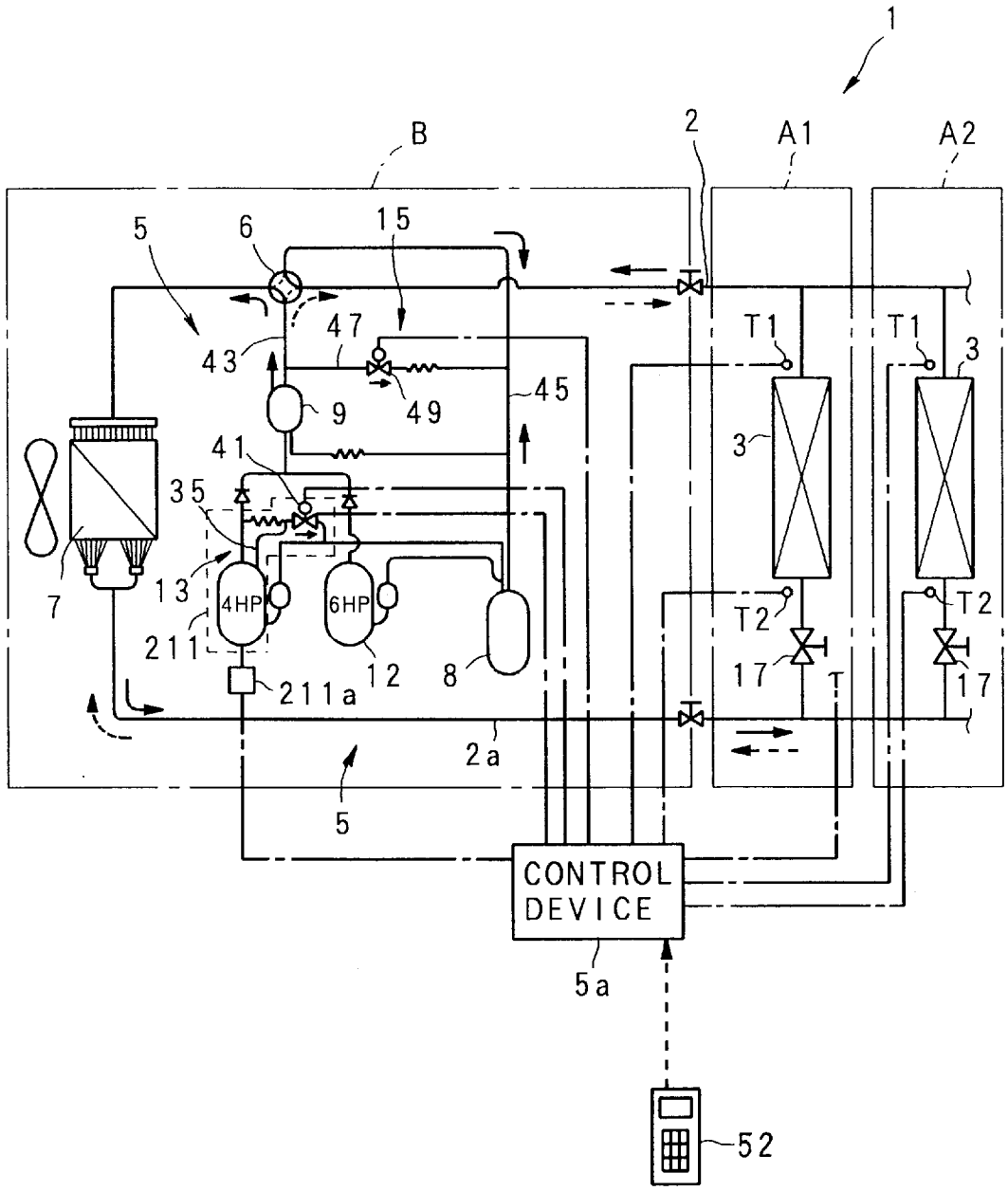
FIG. 11 is a refrigerant circuit diagram showing an air conditioner of a third embodiment of the present invention when the compressor of the air conditioner contains the power control mechanism.

FIG. 11 is a refrigerant circuit showing an air conditioner according to a third embodiment of the present invention.

In this embodiment, one of two compressors 211 comprises a pole-changeable type compressor which has a pole changer 211*a* and a power control mechanism 13 for performing a 50% power save as described above.

Assuming that the compressor 211 has four horsepowers at full power in a two-pole driving mode, the output power of the compressor 211 is reduced to 2 horsepower when the power control mechanism is actuated. Therefore, in a four-pole driving mode, the output power of the compressor 211 is two horsepowers at full power, and it is further reduced to 1 horsepower when the power control mechanism is actuated. In addition, when the return valve 49 is further opened in the above state, the output power as described above is further reduced by 1 horsepower. Accordingly, the total output power of the compressors can be controlled every one horsepower by combining the above control operations. When the valve control operation of the control valve 17 is added to the above power control operation, the smooth and substantially linear power control operation which is substantially identical to that of the inverter compressor can be performed. Like the first and second embodiments, the control of the opening degree of the control valve 17 is first controlled at the initial control stage.

As described above, according to the present invention, the refrigerant control apparatus having the rated compressor is provided with the power control mechanism and the refrigerant return mechanism, and the refrigerant amount discharged from the compressor is controlled by using the power control mechanism and the refrigerant return mechanism. Therefore, the fine power control can be performed in a broad range even by using only the rated compressors, so that the same control as an inverter compressor can be performed without hunting. In addition, peripheral equipments suffer no adverse effect because the refrigerating machine or the air conditioner of this invention does not need an inverter compressor for which the driving power frequency is variable.

Further, the refrigerant amount to be supplied to the refrigerant circuit can be controlled by only the refrigerant control apparatus, and thus other equipments for adjusting the refrigerant amount are unnecessary. Therefore, the construction can be simplified and the number of parts can be reduced.

According to the present invention, plural rated compressors are provided and at least one of the compressors has a power control mechanism. Therefore, in addition to the effect as described above, the power control can be more finely performed in a broader range by suitably combining the compressors.

Further, according to the present invention, a multiroom type air conditioner has the refrigerating machine as described above. Therefore, the fine power control can be performed in a broad range in each indoor unit, and thus comfortable air condition can be obtained. In addition, the refrigerant amount to be supplied to the indoor unit can be controlled by controlling the power of the compressor and the control valve, so that other equipments for controlling the refrigerant amount in the outdoor unit, such as a receiver tank, etc., are not required. Therefore, the construction can be simplified and the number of parts can be reduced.

Still further, according to the present invention, in a heat pump type multiroom air conditioner, the refrigerant amount to be supplied to the indoor unit is first controlled by the control valve which is provided in the indoor unit. Therefore, the air conditioning operation can be suitably performed in accordance with an air conditioning load without a receiver tank, an open/close valve of the outdoor heat exchanger, etc. which are required for the conventional air conditioner. Therefore, the construction can be simplified and the number of parts can be reduced.

According to the present invention, the refrigerant amount to be supplied to the indoor unit is controlled by controlling both the refrigerant control mechanism (refrigerant return mechanism, power control mechanism, pole changer) of the outdoor unit and the control valve of the indoor unit. Therefore, the same smooth and substantially linear power control as the inverter compressor can be performed without using the inverter compressor, the receiver tank, the open/close valve of the outdoor unit, etc. which are required for the conventional air conditioner. Accordingly, the construction can be simplified and the number of parts can be reduced.

Further, according to the present invention, the same effect as described above can be obtained by using the pole-changeable type compressor in place of the rated compressor having the power control mechanism. In addition to the pole-changing operation of the pole-changeable type compressor, a part of the refrigerant discharged from the compressor is returned to the suction side of said compressor by the refrigerant return mechanism to make the refrigeration power variable. Accordingly, by using the refrigerating machine of this invention, no inverter (frequency converter) is required, and if the circulation amount of the refrigerant in the refrigerating machine is adjusted by the control valve in the indoor unit, the outdoor unit needs no control valve for controlling the circulation amount of the refrigerant. Therefore, the receiver and the control valve which are required for the indoor unit in the conventional air conditioner are not required in this invention, so that the construction of the air conditioner can be simplified and the number of parts can be reduced.

In the embodiments as described above, the air conditioner (refrigerating machine) has the compressor having two cylinders, however, it may use a compressor having only one cylinder and a power control mechanism in place of this type of compressor. In this case, the output power is controlled every two horsepowers.

The embodiments as described above are applicable to not only the multiroom air conditioner having plural indoor units A, but also an air conditioner having only one indoor unit A.

In the above embodiments, the rated compressor (power-invariable compressor) having the power control mechanism or the pole-changeable type compressor is used. However, any type of compressor for which the frequency of driving power is fixed may be used insofar as its output power can be varied in combination with a mechanism for returning to the compressor a part of the refrigerant which is under compressor or has been compressed.

What is claimed is:

1. A refrigerating machine including:

a heat exchanger for performing heat exchange between a refrigerant and air;

a compressor having at least one cylinder for compression or sucking;

a power control mechanism which is disposed in said compressor and serves to return a part of the refrigerant in the cylinder under a compressing process to the cylinder under sucking process to reduce an output power of said compressor;

a refrigerant return mechanism for returning a part of the refrigerant discharged from said compressor to a refrigerant suction side of said compressor; and a controller for selectively controlling said power control mechanism and said refrigerant return mechanism to make the output power of said compressor variable.

2. The refrigerating machine as claimed in claim 1, wherein said refrigerating machine includes plural rated compressors, and at least one of said compressors includes said power control mechanism.

3. An air conditioner which is equipped with plural indoor units each having an indoor heat exchanger, and an outdoor unit having a compressor, including a refrigerating machine which comprises:

a heat exchanger for performing heat exchange between a refrigerant and air;

a compressor having at least one cylinder for compression or sucking;

a power control mechanism which is disposed in said compressor and serves to return a part of the refrigerant in the cylinder under a compressing process to the cylinder under sucking process to reduce an output power of said compressor;

a refrigerant return mechanism for returning a part of the refrigerant discharged from said compressor to a refrigerant suction side of said compressor; and a controller for selectively controlling said power control mechanism and said refrigerant return mechanism to make the output power of said compressor variable.

4. The air conditioner as claimed in claim 3, further including a control valve which is provided to each of said indoor units and is actuated in both cooling and heating operations to control the amount of the refrigerant flowing in each indoor heat exchanger and thus control an output power of said air conditioner in accordance with an air conditioning load, whereby the cooling and heating operations are performed in accordance with the air conditioning load.

5. A method of driving an air conditioner which includes plural indoor units each having an indoor heat exchanger and a control valve for controlling a flow-in amount of refrigerant into the indoor heat exchanger, and an outdoor unit having an outdoor heat exchanger, a compressor having at least one cylinder for compression or sucking, a refrigerant return mechanism for returning a part of the refrigerant discharged from said compressor to a refrigerant suction side of said compressor and a power control mechanism for returning a part of the refrigerant in the cylinder under a compression process to the cylinder under sucking process, comprising the steps of:

controlling an opening degree of said control valve in accordance with the air conditioning load to perform a cooling or heating operation in accordance with the air conditioning load in a small range; and controlling selectively the driving of said refrigerant return mechanism and said power control mechanism when it is impossible to perform the cooling or heating operation in accordance with the air conditioning load by only the control of said control valve, whereby the output power of the compressor is controlled variably.

6. A method of driving an air conditioner which includes plural indoor units each having an indoor heat exchanger and a control valve for controlling a flow-in amount of refrigerant into the indoor heat exchanger, and an outdoor unit having an outdoor heat exchanger, a compressor having at least one cylinder for compression or sucking, and at least one of a refrigerant return mechanism for returning a part of the refrigerant discharged from said compressor to a refrigerant suck-in side of said compressor and a power control mechanism for returning a part of the refrigerant in the cylinder under a compression process to the cylinder under sucking process, comprising the steps of:

controlling an opening degree of said control valve in accordance with the air conditioning load to perform a cooling or heating operation in accordance with the air conditioning load in a small range; and controlling selectively the driving of said compressor and at least one of said refrigerant return mechanism and said power control mechanism when it is impossible to perform the cooling or heating operation in accordance with the air conditioning load by only the control of said control valve.

7. An air conditioner which is equipped with plural indoor units each having an indoor heat exchanger, and an outdoor unit having a compressor, including a refrigerating machine which comprises:

a heat exchanger for performing heat exchange between a refrigerant and air;

a compressor having at least one cylinder for compression;

a power control mechanism which is disposed in said compressor and serves to return a part of the refrigerant in the cylinder under a compressing process to the cylinder under sucking process to reduce an output power of said compressor;

a refrigerant return mechanism for returning a part of the refrigerant discharged from said compressor to a refrigerant suction side of said compressor;

a controller for selectively controlling said power control mechanism and said refrigerant return mechanism to make the output power of said compressor variable; and a control valve which is provided to each of said indoor units and is actuated in both cooling and heating operations to control the amount of the refrigerant flowing in each indoor heat exchanger and thus control an output power of said air conditioner in accordance with an air conditioning load, whereby the cooling and heating operations are performed in accordance with the air conditioning load.

* * * * *

UNITED STATES PATENT AND TRADEMARK OFFICE

CERTIFICATE OF CORRECTION

PATENT NO. : 5,768,903

DATED : June 23, 1998

INVENTOR(S) : Kunie Sekigami; Kouji Nagae; Kazutoyo Kagami

It is certified that error appears in the above-identified patent and that said Letters Patent is hereby corrected as shown below:

On the title page, item [75];

Change "Ooizumimachi" to -- Oura --.

Signed and Sealed this

Twentieth Day of October, 1998

*Attest:*

BRUCE LEHMAN

*Attesting Officer*

*Commissioner of Patents and Trademarks*